US005159823A

United States Patent [19]

Fukuda et al.

[11] Patent Number: 5,159,823

[45] Date of Patent: Nov. 3, 1992

[54] WASHING MACHINE

[75] Inventors: Norisuke Fukuda, Tokyo; Koji Murakami, Yokohama, both of Japan

[73] Assignee: Kabushiki Kaisha Toshiba, Kawasaki, Japan

[21] Appl. No.: 677,392

[22] Filed: Apr. 1, 1991

[30] Foreign Application Priority Data

Mar. 30, 1990 [JP] Japan ..... 2-84717
Apr. 28, 1990 [JP] Japan ..... 2-114397

[51] Int. Cl.[5] ..... D06F 33/02

[52] U.S. Cl. ..... 68/12.21; 68/207; 137/387; 137/392

[58] Field of Search ..... 68/12.05, 12.21, 12.27, 68/13 R, 207; 137/387, 392

[56] References Cited

U.S. PATENT DOCUMENTS 3,397,715 8/1968 Fathauer ..... 137/392 X
3,741,683 6/1973 McTamaney et al. ..... 137/392 X
4,662,390 5/1987 Hawkins ..... 137/392

FOREIGN PATENT DOCUMENTS 0142052 12/1978 Japan ..... 68/13 R
0114014 9/1981 Japan ..... 137/392
57-40070 9/1982 Japan .
0166193 9/1984 Japan ..... 68/13 R
0047878 10/1985 Japan ..... 68/12.21

*Primary Examiner*—Philip R. Coe
*Attorney, Agent, or Firm*—Cushman, Darby & Cushman

[57] ABSTRACT

A washing machine which comprises a fixed outer tub, a washing or drying tub which is rotatably provided in the outer tub, a first electrode which is provided at the upper portion of the outer tub and connected to a high-frequency signal source, a second electrode which is provided at the upper portion of the washing or drying tub and forms an input condenser for high-frequency signal input together with the first electrode, a third electrode which is provided at the upper portion of the outer tub and connected to a high-frequency signal detecting circuit, a fourth electrode which is provided at the upper portion of the washing or drying tub and forms the output condenser for getting a high-frequency signal together with the third electrode, and water-level detecting means which is provided at a predetermined position of the washing or drying tub in electrical communication with the second and fourth electrodes so as to designate change of impedance defined between the second and fourth electrodes in accordance with the water level in the washing or drying tub.

6 Claims, 20 Drawing Sheets

WASHING MACHINE

BACKGROUND OF THE INVENTION

1. Field of the Invention

The present invention relates, generally, to a household washing machine for washing clothing with water and cleaning material, and, particularly, to detection of water level in the washing tub of the washing machine.

2. Description of the Prior Art

Generally, most household washing machines have a two-tub structure which comprises a rotatable washing tub and another water receiving tub fixed around the washing tub so as to receive water discharged thereform. Some washing machines have a one-tub structure in which the washing tub and the water-receiving tub are integrated together. Moreover, as compared with the two-tub washing machine, the one-tub washing machine is advantageous in that both the amount of washing water and the body size can be reduced. Also, the one-tub washing machine can use washing soap powder whose solubility to water is generally low.

In either case of the above-mentioned washing machines, the washing operation comprises three steps, i.e. washing, rinsing and drying. When switching between these three steps, water supply and drainage are carried out under control of the water level. Accordingly, detecting the water level is very essential for the operation of these washing machines.

Next, detecting the water level is described with respect to the two-tub washing machine. Since the water-receiving tub is fixed, it is possible to provide at the tub a conduit so that the water level in the conduit is changed in accordance with the water level in the washing tub. Therefore, the most general method to detect the water level in the washing tub is to measure the pressure change of air caused by movement of water introduced in the conduit by a diaphragm sensor connected thereto.

On the other hand, with respect to the one-tub washing machine, since it has a structure such that the washing tub and the water-receiving tub are intergrally rotated, it is not possible or extremely difficult to detect the water level as done in the two-tub washing machine.

An example of conventional methods of detecting information on the water level in the washing tub of the one-tub washing machine is shown in FIGS. 1*a* (PRIOR ART), 1*b* (PRIOR ART) and 1*c* (PRIOR ART), which is disclosed in Japanese Utility Model Application for Publication No. 57-40070. In FIG. 1*a*, reference numeral 71 designates an upper portion of a fixed outer tub, 72 shows a washing tub rotatably disposed in the outer tub. 73 shows a pulsator, 74 shows a metal pulsator shaft, and 75 shows a drive system including a clutch or the like. In such a construction, the drive system 75 is in a conducting relation to water in the washing tub 72 through the shaft 74. Moreover, a first electrode 76 is provided at the upper portion 71. On the other hand, at the top surface of the washing tub 72, there is provided a second electrode 77 for forming an air condenser CA together with the first electrode 76. The second electrode 77 is connected to a third electrode plate 78 which is arranged on the inner wall of the washing tub 72. Furthermore, the first electrode 76 and the drive system 75 are connected to each other through an oscillating circuit 79.

The oscillating circuit 79 is composed of an integrating RC circuit in which inverters and resistors are used as shown in FIG. 1*b*. Moreover, as shown in FIG. 1*c*, both ends of a part comprising a series connection of the air condenser CA and an impedance Zc between the third electrode plate 78 and the drive system 75 are connected to the oscillating circuit 79 respectively. When water is supplied to the washing tub 72, and the water level reaches the third electrode plate 78, the impedance Zc between the third electrode 78 and the drive system 75 is largely changed, so that the oscillation frequency of the oscillating circuit 79 changes largely. In such a manner, the water level in the washing tub 72 can be detected.

As stated above, in the washing machine of the one-tub structure in which the washing tub and the water-receiving tub are integrally formed together, it is very difficult to correctly know the air pressure change caused by change of the water level in the washing tub because the water-receiving tub is rotated together with the washing tub. Therefore, it is impossible to apply the pressure sensor method as used in the two-tub washing machine to the one-tub washing machine.

On the other hand, in the above-mentioned conventional apparatus for detecting the water level in the washing tub of the one-tub washing machine, as shown in FIG. 1*a*, since the air condenser CA for deciding the oscillating frequency is connected to the oscillating circuit through the drive system 75 around which a motor or the like is existent, a noise is likely to be generated in the connection route so that detection error may be caused. In order to solve this problem, it is necessary to provide a special shield for the drive system. However, if such a shield is provided, the construction becomes so complex as to lead to troublesome production and high cost.

SUMMARY OF THE INVENTION

The present invention was made in view of the above-mentioned problem. It is therefore, an object of the present invention to provide a washing machine with a one-tub structure which can realize high-accuracy water-level detection in the washing or drying tub with a simple and low-cost structure.

To achieve this object, the washing machine according to the present invention comprises a fixed outer tub, a washing or drying tub which is rotatably provided in the outer tub, a first electrode which is provided at the upper portion of the outer tub and connected to a high-frequency signal source, a second electrode which is provided at the upper portion of the washing or drying tub and forms an input condenser for high-frequency signal input together with the first electrode, a third electrode which is provided at the upper portion of the outer tub and connected to a high-frequency signal detecting circuit, a fourth electrode which is provided at the upper portion of the washing or drying tub and forms an output condenser for getting a high-frequency signal together with the third electrode, and water-level detecting means which is provided at a predetermined position of the washing or drying tub in electrical communication with the second and fourth electrodes so as to detect change of impedance between the second and fourth electrodes, which is caused by change of water level in the washing or drying tub.

In the above construction, when the water level reaches the water-level detecting means by water supply to the washing or drying tub, the impedance between the second and fourth electrodes is changed, so that the level of a high frequency signal inputted from the high-frequency signal source through the input condenser is changed. Then, the high-frequency signal is inputted to the high-frequency signal detecting circuit through the output condenser so that the signal level change is detected. Thus, the relationship between the actual and predetermined water levels in the washing or drying tub can be detected with high accuracy based on the detection of signal level change.

These and other objects, features and advantages of the present invention will be more apparent from the following description of a preferred embodiment, taken in conjuction with the accompanying drawings.

DETAILED DESCRIPTION OF THE EMBODIMENT

FIGS. 2 to 8 show a first embodiment of the present invention.

Figure 1A:
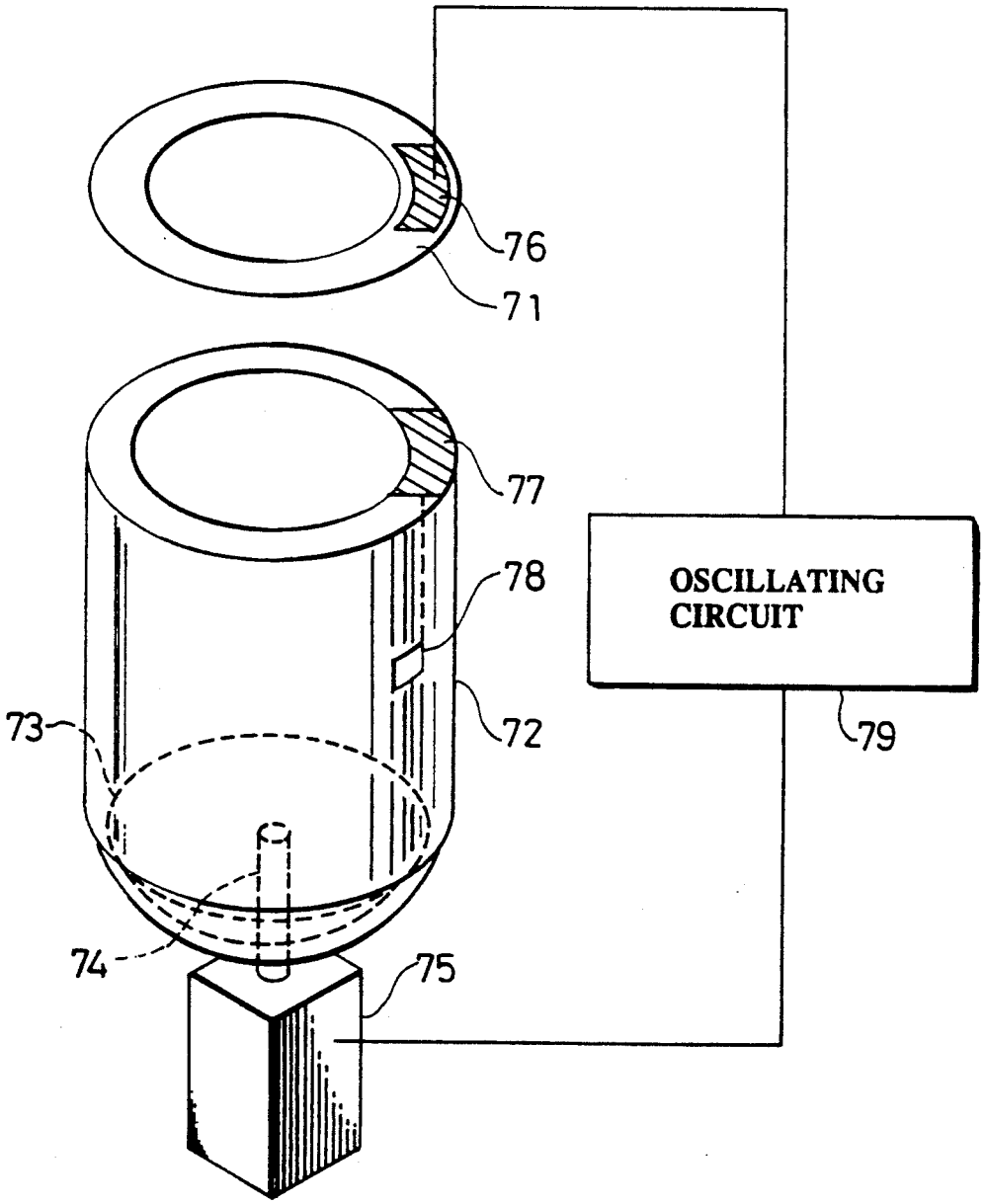
FIG.1a (PRIOR ART)
FIGS. 1*a* (PRIOR ART) and 1*b* (PRIOR ART) and 1*c* (PRIOR ART) are diagrams showing a water-level detecting apparatus in a convention washing machine.
Figure 1B:
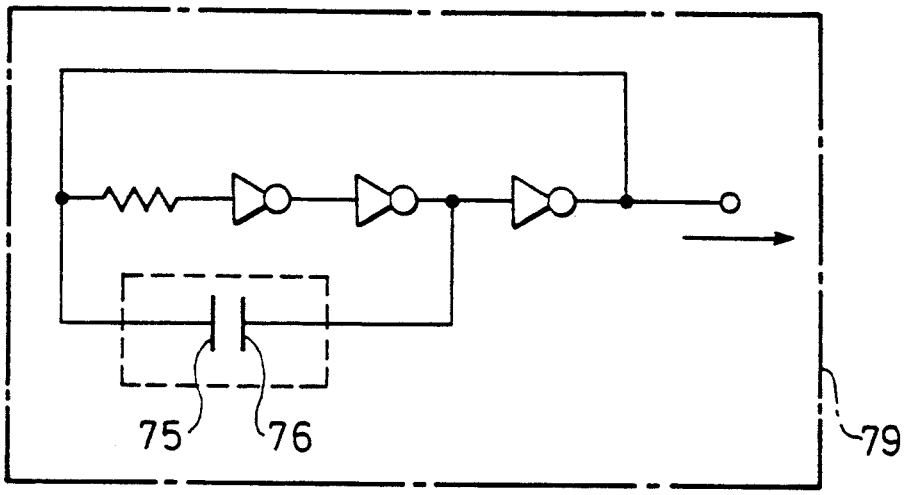
FIG.1b (PRIOR ART)
Figure 1C:
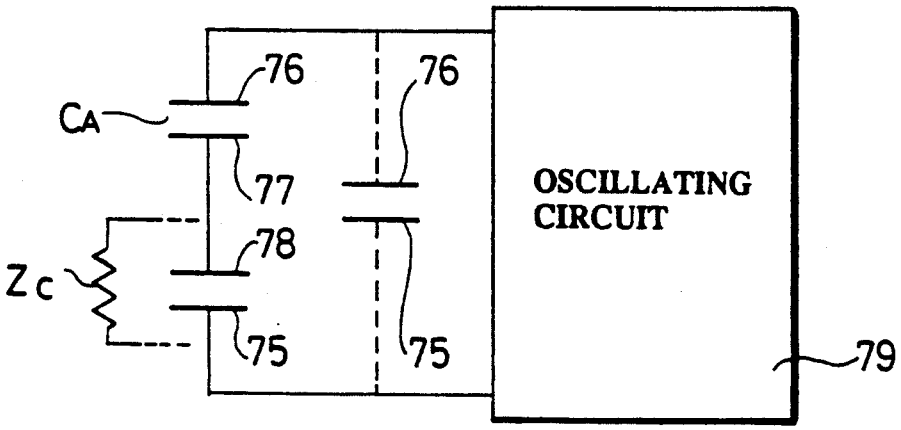
FIG.1c (PRIOR ART)
Figure 2:
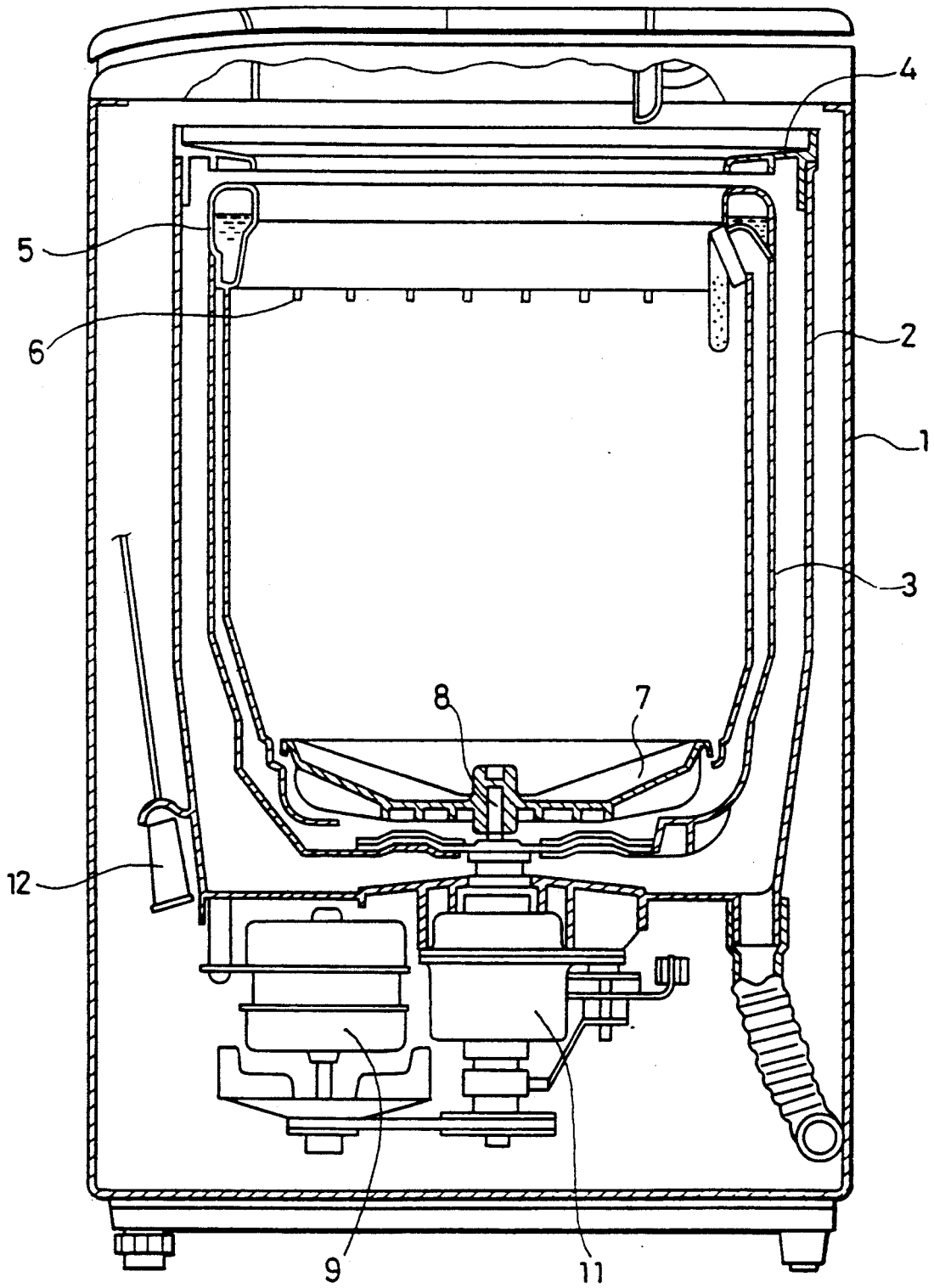
FIG. 2 shows a cross-section of a first embodiment of a washing machine according to the present invention.

First, the structure of a washing machine according to the present invention will be described. In FIG. 2, reference numeral 1 shows an outer box in which is fixed an outer tub 2 comprising an insulating material. Moreover, in the outer tub 2 is rotatably disposed a washing or drying tub 3 comprising an insulating material, in which clothing to be washed and water are received. At the top of the outer tub 2, an outer-tub cover 4 is attached. At the upper portion of the washing or drying tub 3 is a balance ring 5 for keeping balance of the tub 3 on rotation and a plurality of holes for discharging water during draining are respectively provided. Moreover, at the central portion of the bottom of the washing or drying tub 3, there is provided a pulsator 7 for stirring water and clothing when washing. The pulsator 7 is fixed to a shaft 8 and rotated by a motor 9 through a belt and drive system 11. Furthermore, the outer tub 2, washing or drying tub 3, motor 9 and drive system 11 are respectively connected to the outer box 1 through a spring vibration insulator 12.

Figure 3:
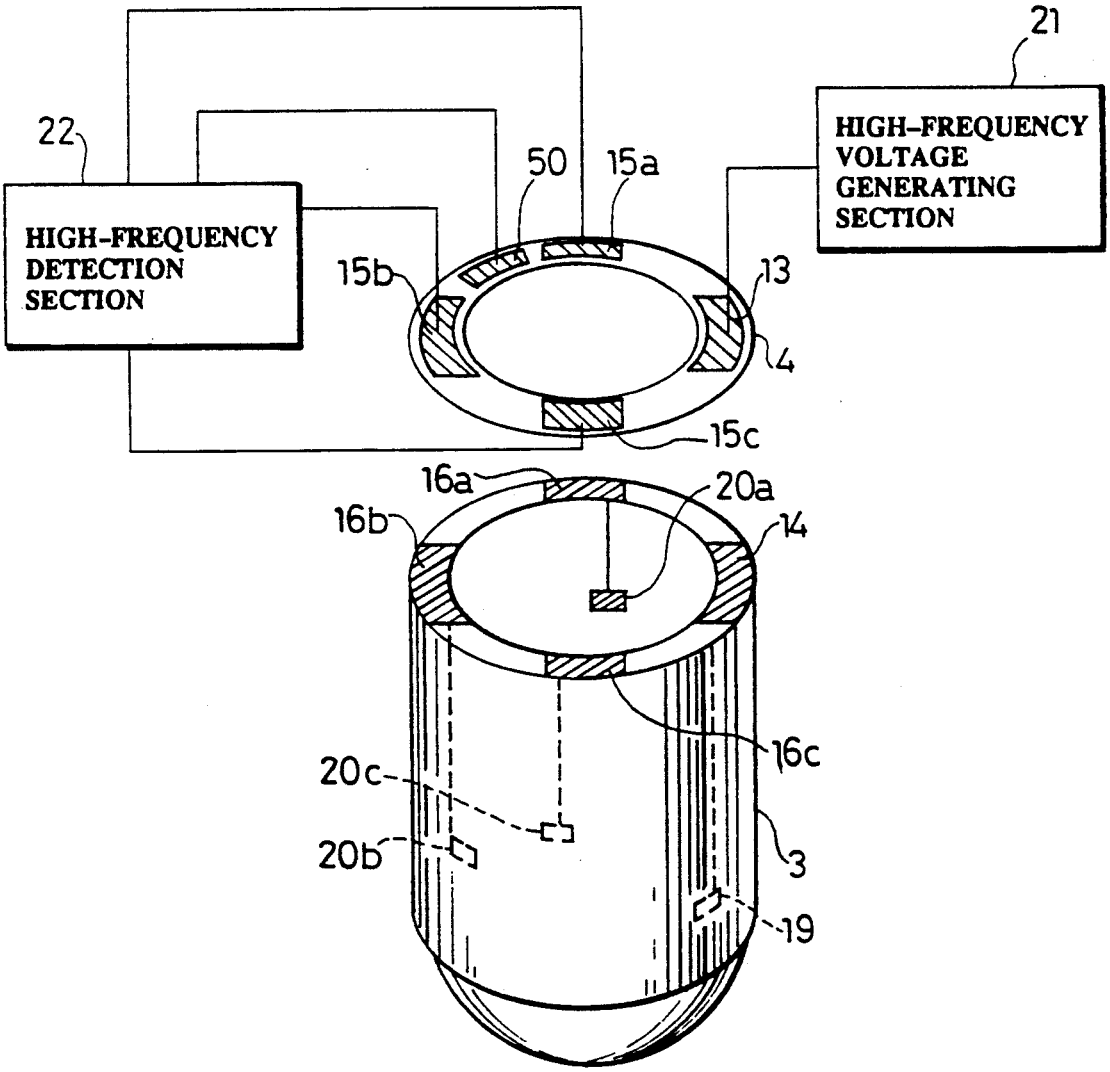
FIG. 3 is a perspective view showing an arrangement of respective electrodes and the like of the first embodiment.

FIG. 3 shows the arrangement of respective electrodes for constructing a water-level detecting means in the washing or drying tub 3. In the arrangement, there are provide a first electrode 13 and a plurality of third electrodes 15*a*, 15*b*, 15*c* at the outer-tub cover 4 shown in FIG. 2. The first electrode 13 is connected to a high-frequency voltage generating circuit 21 as a high-frequency signal source, and the plurality of third electrodes 15*a*, 15*b*, 15*c* are respectively connected to a high-frequency signal detection circuit 22 as a high-frequency signal detecting circuit. Moreover, at the upper portion of the washing or drying tub 3 facing the outer-tub cover 4, there are provided a second electrode 14 which forms an input condenser Ci as an air condenser for high-frequency signal input together with the first electrode 13, and a plurality of fourth electrodes 16*a*, 16*b*, 16*c* which respectively form an output condenser Co as an air condenser for getting a high-frequency signal together with the respective third electrodes 15*a*, 15*b*, 15*c*.

Furthermore, on the inner wall of the washing or drying tub 3, there are respectively attached a fifth electrode plate 19 connected to the second electrode 14, and sixth electrode plates 20*a*, 20*b*, 20*c* respectively corresponding to the fourth electrodes 16*a*, 16*b*, 16*c*. Among these electrodes, the fifth electrode plate 19 is attached at the lowest position, and the sixth electrode plates 20*a*, 20*b*, 20*c* are respectively attached at different height. When water is supplied to the washing or drying tub 3, and the water level reaches, for example, the height of the sixth electrode plate 20*b*, the fifth electrode plate 19 and the sixth electrode plate 20*b* are in conduction relation to each other through water. As the result, the impedance between the second electrode 14 and the fourth electrode 16*b* is changed. Namely, according to such arrangement, water-level detecting means is constructed, by which the water level in the washing or drying tub can be detected based on the change of impedance between the second electrode 14 and the fourth electrodes 16*a*, 16*b*, 16*c* through the fifth electrode plate 19 and the plurality of sixth electrode plates 20*a*, 20*b*, 20*c*. Incidentally, at the outer-tub cover 4, there is provided a dummy electrode 50 for compensation of floating capacity connected to the high-frequency signal detection section 22.

Figure 4:
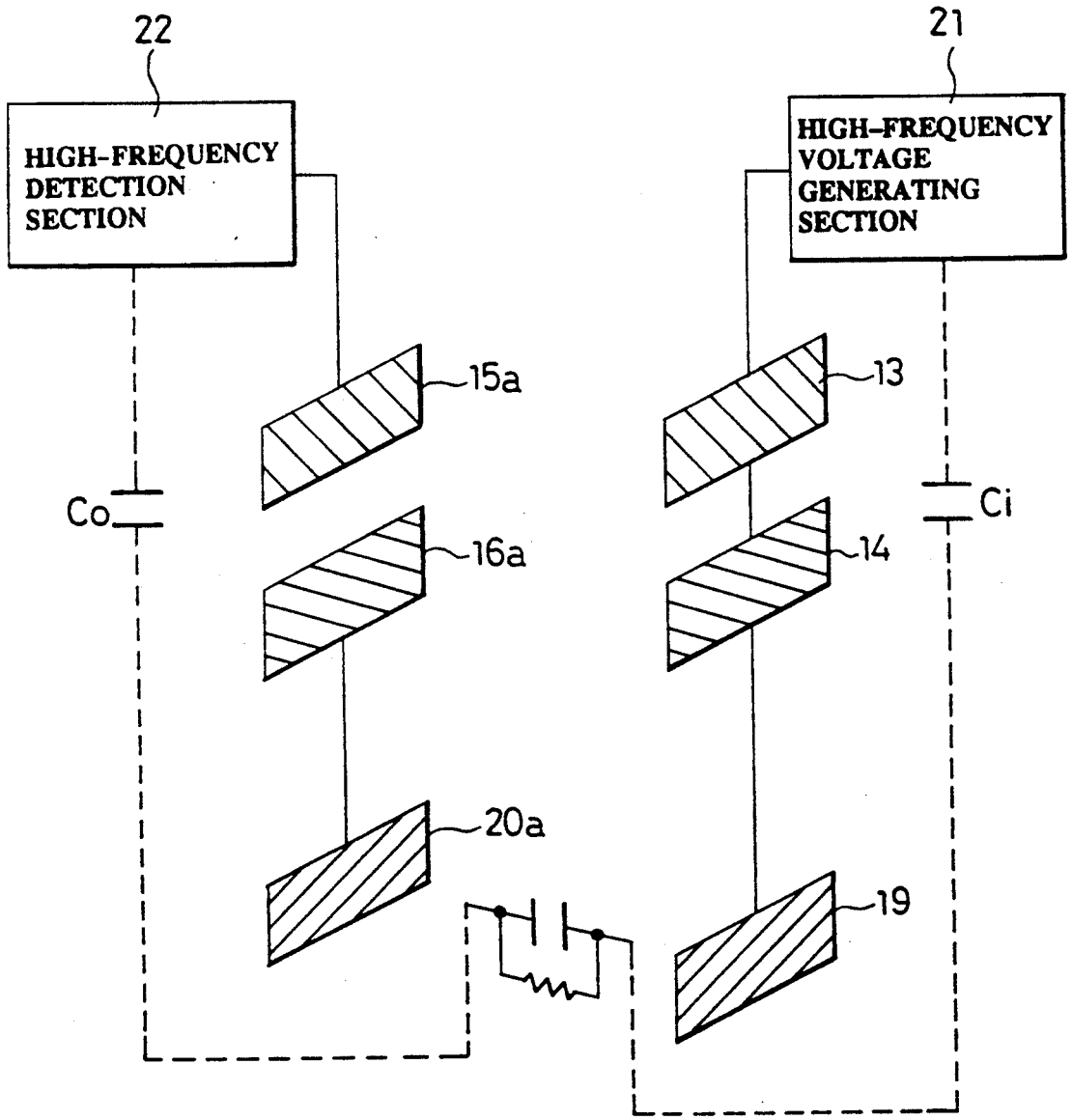
FIG. 4 is a diagram showing a signal route of a high-frequency signal of the first embodiment.

FIG. 4 shows a route of a high-frequency signal. According to the route, a high-frequency signal outputted from the high-frequency voltage generating circuit 21 reaches the fifth electrode plate 19 on the inner wall of the washing or drying tub 3 through the input condenser Ci composed of the first electrode 13 of the outer-tub cover 4 and the second electrode 14 of the washing or drying tub 3. In such a state, when water is supplied to the washing or drying tub 3, and the water level reaches between the sixth electrode plate 20*a* and the fifth electrode plate 19 on the inner wall of the tub 3, the electrodes 19 and 20*a* are in conduction relation to each other through water. As the result, the high-frequency signal is propagated to the sixth electrode plate 20*a* from the fifth electrode plate 19, then inputted to the high-frequency signal detection circuit 22 through the output condenser Co composed of the third electrode 15*a* of the outer-tub cover 4 and the fourth electrode 16*a* of the washing or drying tub 3. Accordingly, the comparison result between the water level in the washing or drying tub 3 and the height of the sixth electrode plate 20*a* can be obtained by detection of the high-frequency signal by means of the detection circuit 22.

Figure 5:
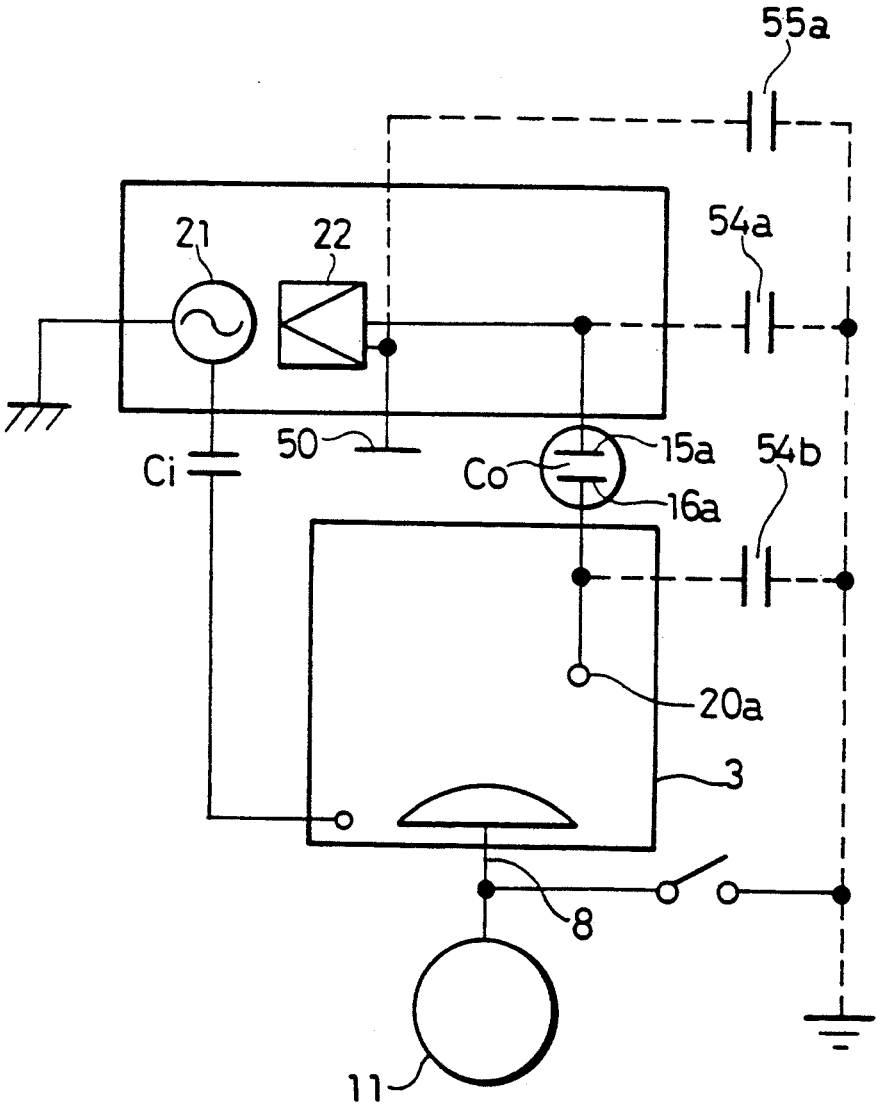
FIG. 5 is a functional diagram of a dummy electrode of the first embodiment.

In this case, as shown in FIG. 5, other high-frequency signals are also inputted as noise to the high-frequency signal detection section 22 through respective floating capacitors 54*a*, 54*b* between the ground and the third and fourth electrodes 15*a*, 16*a*. On the other hand, another floating capacitor 55*a* is formed between the ground and the fourth electrode 16*a* and the dummy electrode 50. Incidentally, if the respective areas of electrodes 15*a* and 50 are equally set, the value of floating capacitor 55*a* becomes approximately the same as the floating capacitor 54*a* between the electrode 15*a* and the ground. Moreover, the difference between the floating capacitors 55*a* and 54*a* varies with the electrical condition around the respective electrodes 15*a*, 50 or the outer box 1. The high-frequency signal of the high-frequency voltage generating section 21 is introduced into the ground through the input condenser Ci and the main body, and then inputted to the high-frequency signal detection section 22 from the ground through the floating capacitor 55*a*.

Accordingly, the high-frequency signal detection section 22 is constructed so that the noise caused by the floating capacity 54*a* between the ground and the third electrode 15*a* is cancelled by an a.c. signal transmitted through the floating capacity 55*a* between the fourth electrode 16*a* and the dummy electrode 50 so as to elevate the SN ratio, and the water level in the washing or drying tub 3 can be detected with high accuracy.

Figure 6:
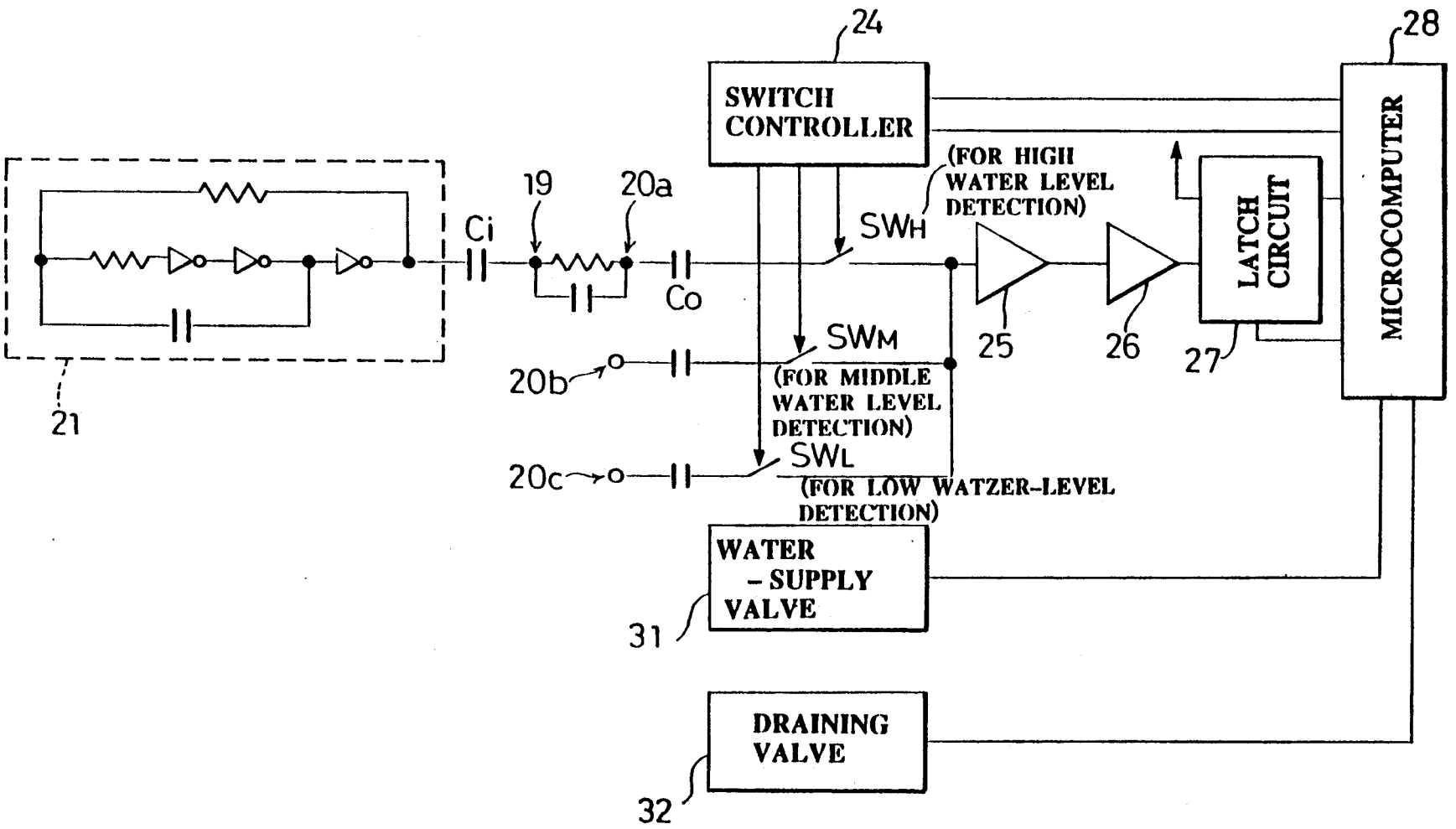
FIG. 6 is a diagram showing a water-level detecting system of the first embodiment.

FIG. 6 is a system diagram of the above-mentioned water-level detecting means. The system of the water-level detecting means comprises a switch controller 24, filter 25, amplifier 26, latch circuit 27, microcomputer 28, water-supply valve 31 and draining valve 32.

As described above, if water is suitably supplied in the washing or drying tub 3, the high-frequency signal outputted from the high-frequency voltage generating circuit 21 is transmitted to the output condenser Co through the input condenser Ci and the fifth or sixth electrode in accordance with the water level. Then, the signal is inputted to the filter 25 from the output condenser Co through any one of a low water-level detection switch SWL, middle water-level detection switch SWM and high water-level detection switch SWH, which is selected by the switch controller 24 under control of the microcomputer 28. By the filter 25, unnecessary frequency signal components are attenuated, thereafter the resultant signal is inputted to the latch circuit 27 through the amplifier 26. Then, based on the output from the latch circuit 27, the water level in the washing or drying tub 3 is judged by the microcomputer 28 so as to control the water-supply valve 31 or draining valve 32.

Figure 7:
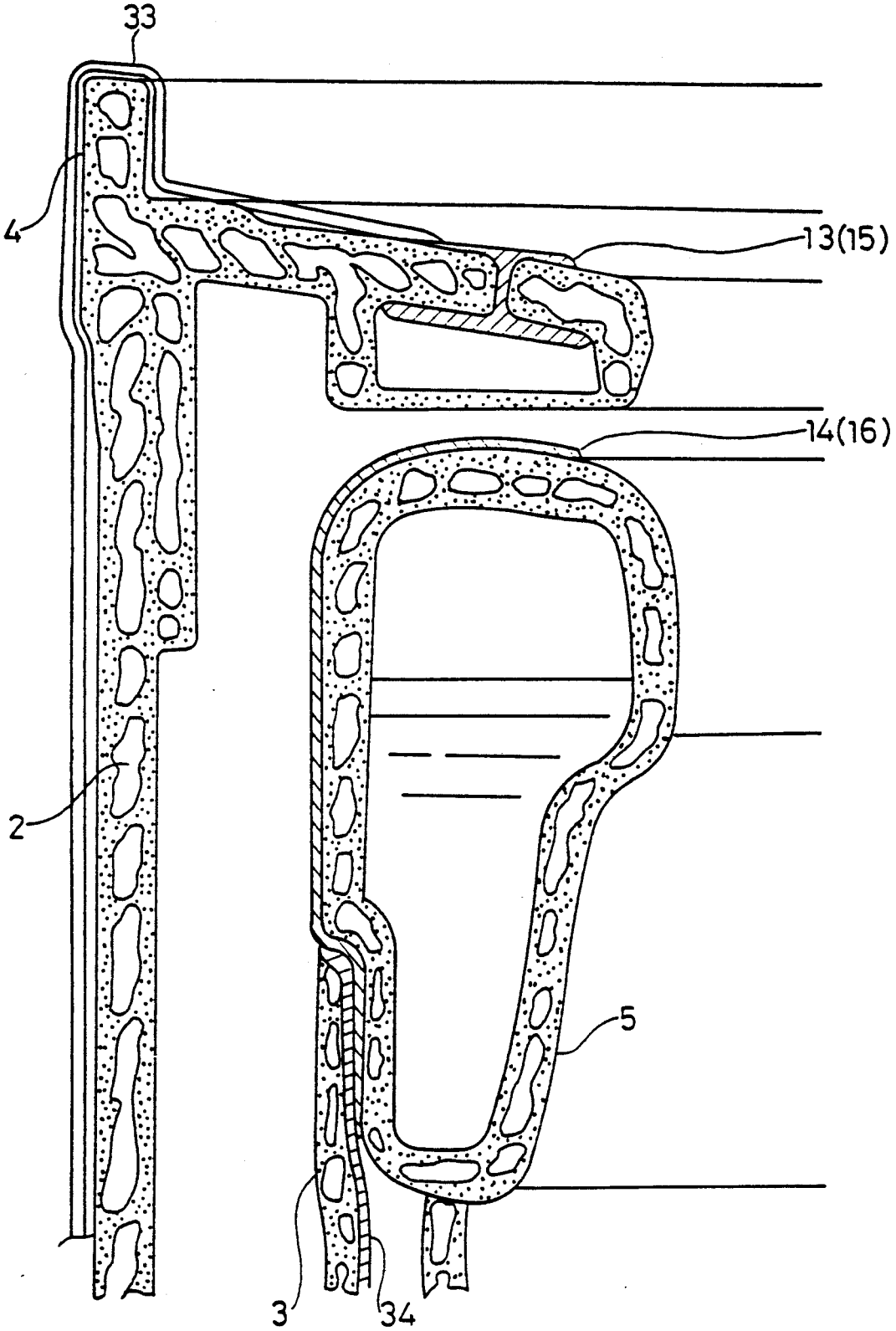
FIG. 7 is a cross section showing an important portion of an attachment structure of the first embodiment of respective electrodes.

FIG. 7 shows attachment structure of electrodes which respectively face each other between the outer-tub cover 4 and the washing or drying tub 3. In the same drawing, the first electrode 13 (or the third electrode 15 provided at the outer-tub cover 4 and the second electrode 14 (or the fourth electrode 16) provided at the balance ring 5 of the washing or drying tub 3 are shown. Incidentally, the first electrode 13 (or the third electrode 15) and the second electrode 14 (or the fourth electrode 16) may be formed with conductive coating materials, metal plates or other conductive members. Moreover, the first electrode 13 (or the third electrode 15) is connected to the high-frequency voltage generating circuit 21 or the switch SWL, SWM or SWH through a lead line 33. The second electrode 14 (or the fourth electrode 16) is connected to the fifth or sixth electrode plate in the washing or drying tub 3 through a lead line 34.

Figure 8:
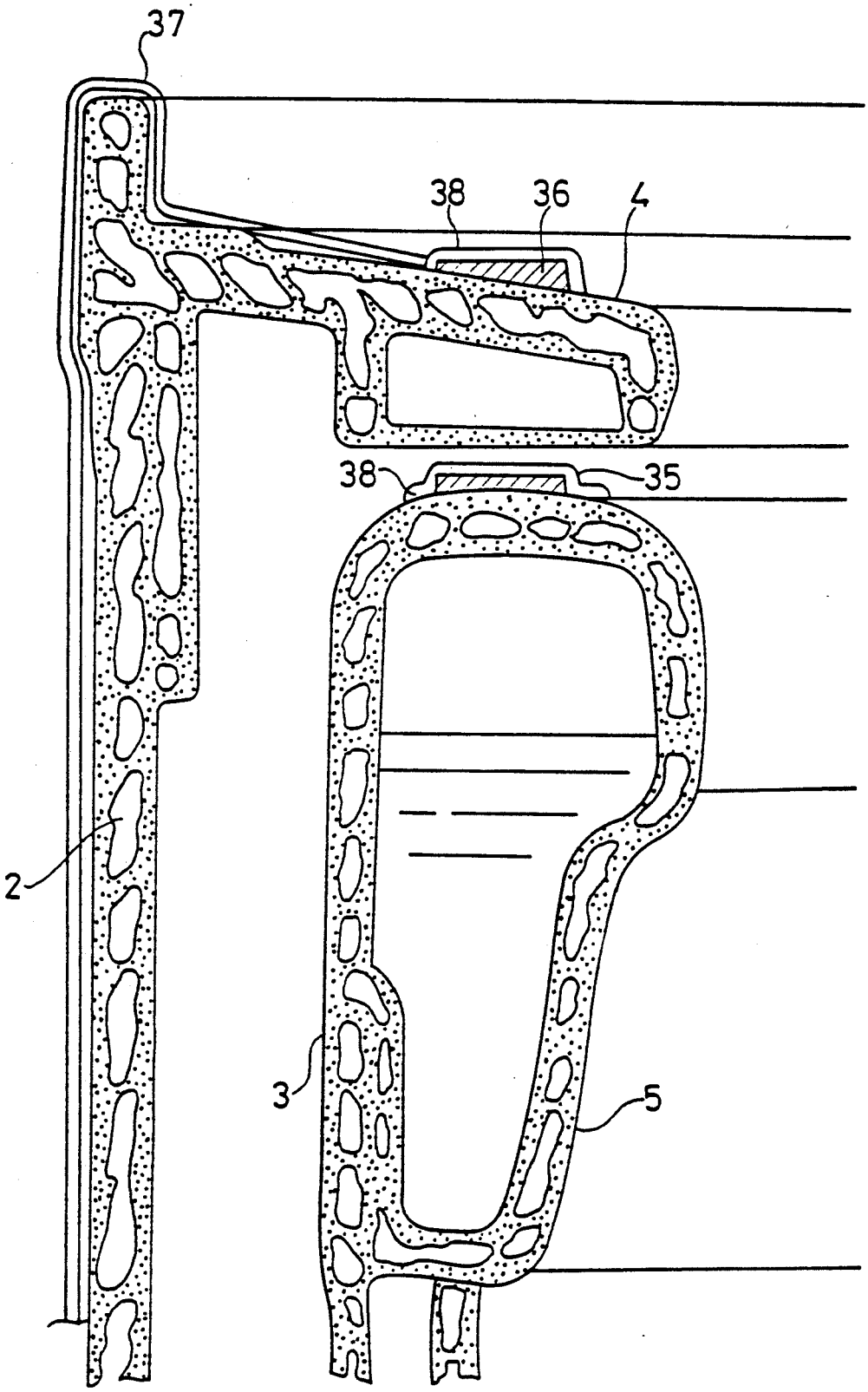
FIG. 8 is a cross section showing an important portion of an alignment structure of the first embodiment.

FIG. 8 shows an alignment manner between the first electrode 13 (or the third electrode 15) on the side of the outer-tub cover 4 and the second electrode 14 (or the fourth electrode 16) on the side of the washing or drying tub 3.

In the alignment, the first electrode 13 on the side of the outer-tub cover 4 and the second electrode 14 on the side of the washing or drying tub 3 are so arranged that these two electrodes 13, 14 correspond to each other. Namely, if both of the positional relations between the first electrode 13 and the outer-tub cover 4 and between the second electrode 14 and the balance ring 5 are determined in advance, then the outer-tub cover 4 and the balance ring 5 are aligned to each other and the one to one correspondence between both of the electrodes 13 and 14 can be assured. Of course, by the alignment, the positional correspondence between the third electrodes 15*a*, 15*b*, 15*c* on the side of the outer-tub cover 4 and the fourth electrodes 16*a*, 16*b* 16*c* on the side of the washing or drying tub 3 can be respectively assured, too.

In order to realize the alignment, in this embodiment, a permanent magnet 35 is fixed on the balance ring 5 and a lead switch 36 is provided at the outer-tub cover 4. The output terminal of lead switch 36 is connected to the above-mentioned microcomputer 28 through a lead line 37. Accordingly, the completion of the alignment can be judged from the output of lead switch 36. In this case, though the permanent magnet 35 and the lead switch 36 are sealed with a resin 38, it is also possible to attach these members with other suitable materials.

Figure 9:
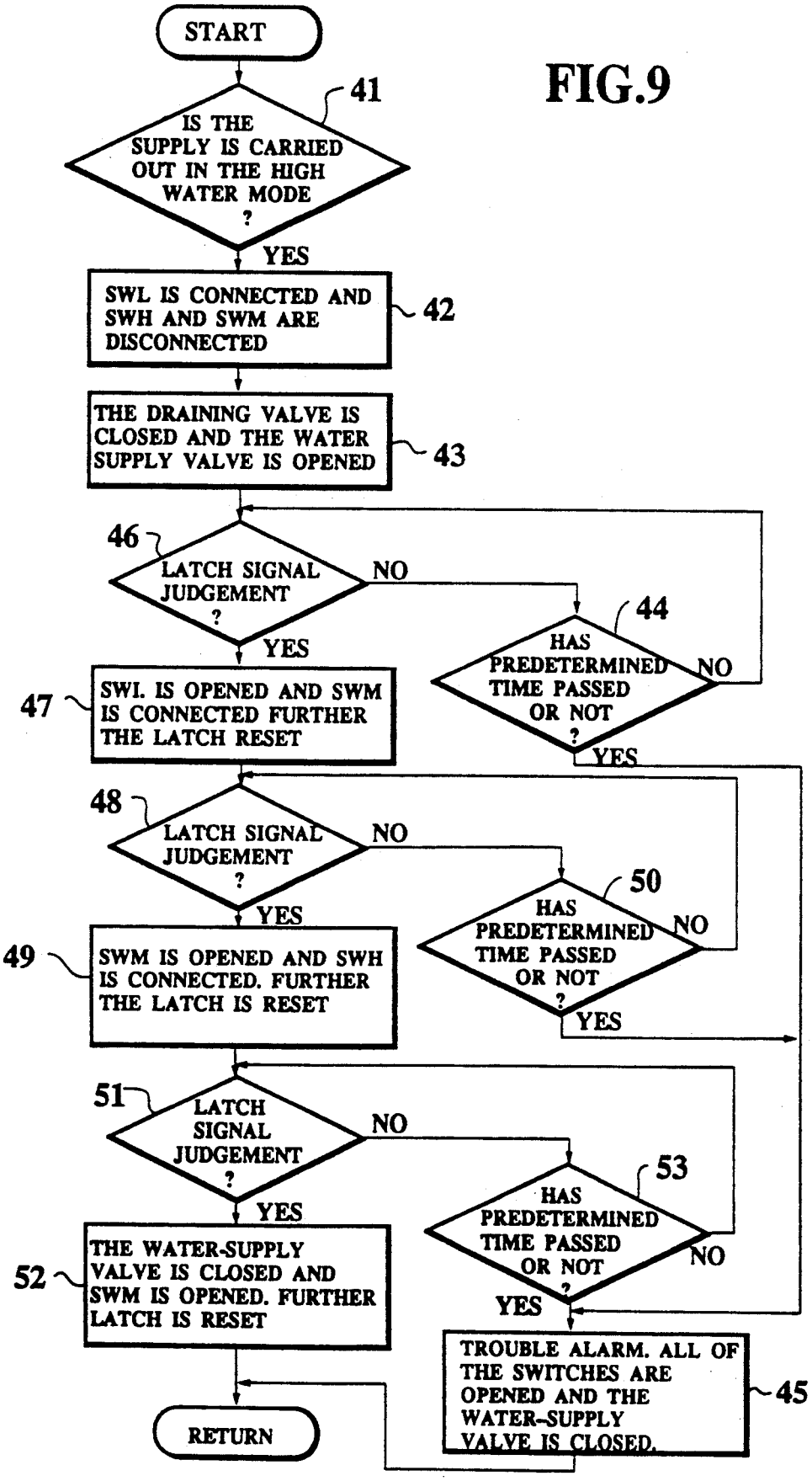
FIG. 9 is a flowchart explaining a control operation of a water-supply valve of the first embodiment and a draining valve.

Next, the water-level detection and the control operation of the water-supply valve and draining valve according to the microcomputer 28 are explained with reference to FIG. 9. The water level in the washing or drying tub 3 is set at three steps (low, middle and high water levels), for example, by changing the height of the sixth electrode plates 20*a*, 20*b*, 20*c*. For explaining the switch control shown in FIG. 6, a case where water supply is carried out in the high water level mode (Step 41) is described. In this case, the microcomputer 28 connects the switch SWL for low water level detection and disconnects the other switches SWM and SWH (Step 42). Then, the water-supply valve is opened and the water supply is continued until the latch signal is inverted (Step 43). When the water-level in the washing or drying tub 3 is increased up to the sixth electrode plate at a predetermined low water level, a high-frequency signal passes through the switch SWL and the latch signal is inverted. However, when the latch signal is not inverted even after a lapse of predetermined time, the microcomputer 28 judges that some error occurs at the water-supply valve or another circuit part, and stops the water supply and generates an alarm (Steps 44, 45). On the other hand, when first latch signal is received, the microcomputer 28 opens the switch SWL and connects the switch SWM for middle water level detection, then resets the latch circuit (Steps 46, 47). Thereafter, when the latch signal is inverted within a lapse of predetermined time in the same manner as mentioned above, the microcomputer 28 judges that the water level in the washing or drying tub 3 reaches a predetermined middle water level, and opens the switch SWM and connects the switch SWH for high water level detection, then resets the latch circuit (Steps 48, 49). Thereafter, when the latch signal is inverted within a lapse of predetermined time, the microcomputer 28 judges that the water level in the washing or drying tub 3 reaches a predetermined high water level, and closes the water-supply valve, so that the control operation is completed. At the time, all of the switches are opened or disconnected, an the latch circuit is reset (Steps 51, 52).

Figure 10:
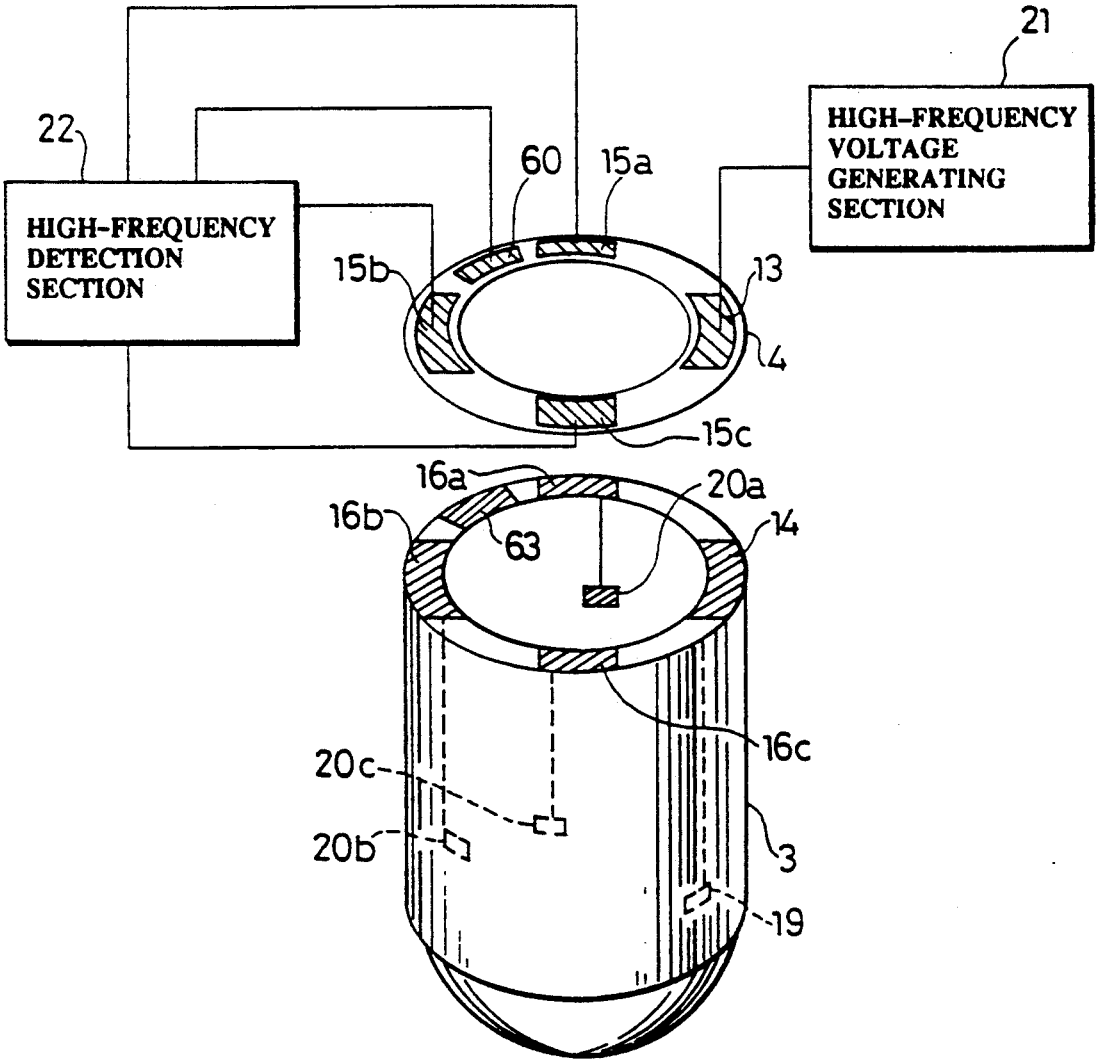
FIG. 10 is a perspective view showing wiring in a first modification of the first embodiment shown in FIG. 3.

Next, a first modification of the first embodiment is explained with reference to FIG. 10. The first modification is characterized in that dummy electrodes 60 and 63 for compensation of floating capacity are respectively provided at the outer-tub cover 4 and the washing or drying tub 3 so that these electrodes 60, 63 face each other when the third electrode 15*a* and the fourth electrode 16*a* are aligned to each other. However, since the other construction is the same as in the first embodiment, the detailed explanation is omitted here.

Figure 11:
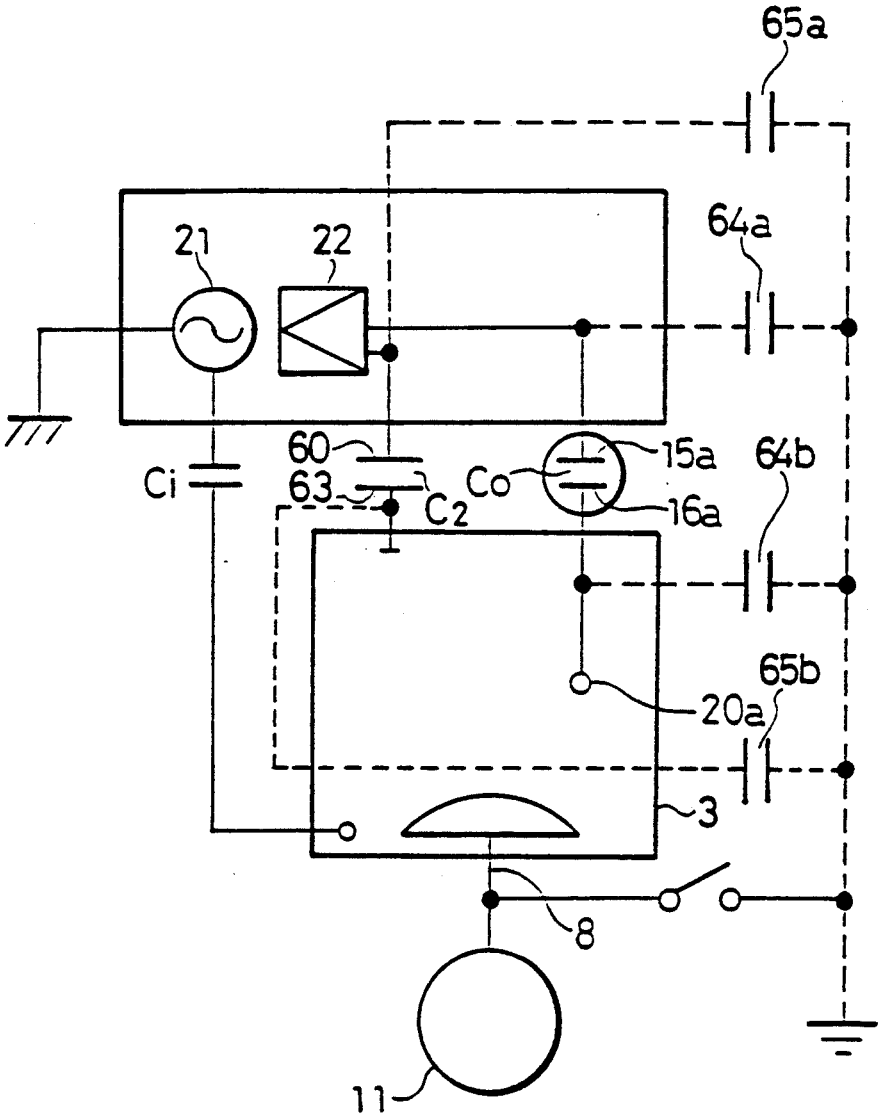
FIG. 11 is a functional diagram of a dummy electrode in the first modification of the first embodiment.

In the first modification, as shown in FIG. 11, a floating capacitor 65*b* is formed between the ground and the dummy electrode 63. If the respective areas of electrodes 16*a* and 63 are set at the same value, the largeness of the floating capacity 65*b* becomes approximately the same as a floating capacity 64*b* defined between the ground and the fourth electrode 16*a*. The difference of largeness between the floating capacitors 65*b* and 64*b* varies with the electrical environment around the respective electrodes 16*a*, 63 or the outer box 1. In this case, a high-frequency signal of the high-frequency voltage generating section 21 is introduced to the ground through the input condenser Ci and the main body, then inputted to the high-frequency signal detection section 22 through the floating capacitor 65*b*. By means of the dummy electrode 63 and 60 for compensation of the floating capacitor, the influence caused by the floating capacitors 64*a*, 64*b* related to the electrodes 15*a* and 16*a* or air condenser Co is eliminated or reduced so as to elevate the SN ratio. As the result, the detection water level in the washing or drying tub 3 can be carried out with high accuracy.

Figure 12:
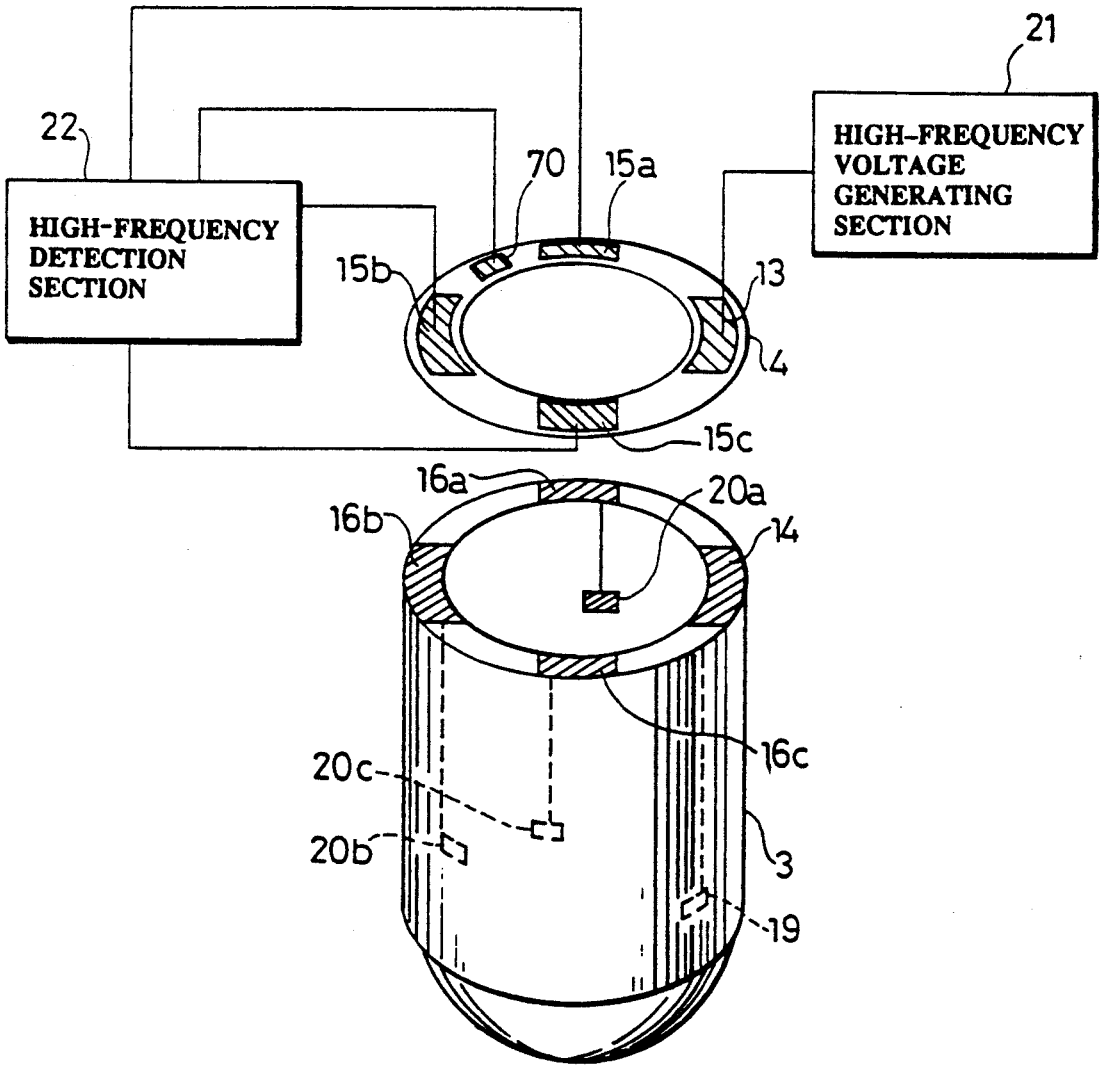
FIG. 12 is a perspective view showing wiring in a second modification of the first embodiment shown in FIG. 3.

Next, a second modification of the first embodiment is explained with reference to FIG. 12. The second modification is characterized in that the area of a dummy electrode 70 provided at the outer-tub cover 4 for compensation of the floating capacitor is adjusted at 1/N (N is a real number) to the area of the electrode 15*a*. However, the other construction is the same as in the first embodiment. Moreover, the noise caused by the floating capacitor between the ground and the electrode 15*a* is cancelled with the noise caused by the floating capacitor between the ground and the dummy electrode 70 so as to elevate the SN ratio, and thus the water level in the washing or drying tub 3 can be detected with high accuracy.

Figure 13:
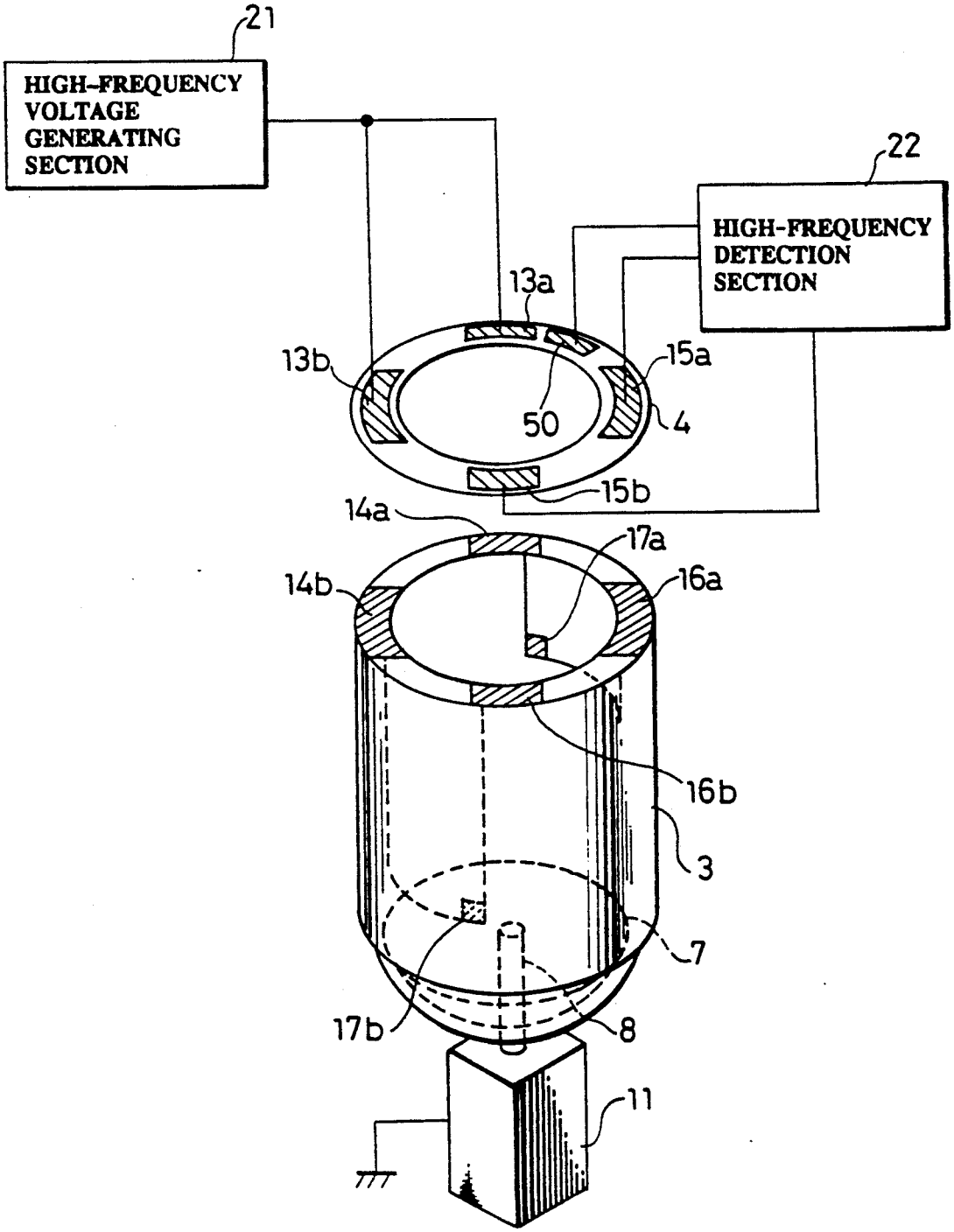
FIG. 13 is a perspective view showing wiring of the respective electrodes of a second embodiment of the present invention.

Next, a second embodiment of the present invention is described with reference to FIGS. 13 to 15. The same members or parts as in FIGS. 3 to 6 are respectively designated by the same reference numerals or characters, and further explanation of such parts is omitted.

In this case, a plurality of first electrodes 13*a*, 13*b* and a plurality of third electrodes 15*a*, 15*b* are provided at the outer-tub cover 4. Moreover, the first electrodes 13*a*, 13*b* are respectively connected to the high-frequency voltage generating circuit 21, while the third electrodes 15*a*, 15*b* are respectively connected to the high-frequency signal detection circuit 22. On the other hand, at the top portion of the washing or drying tub 3 facing the outer-tub cover 4, there are provided a plurality of second electrodes 14*a*, 14*b* which respectively form an input condenser Ci for inputting a high-frequency signal together with the first electrodes 13*a*, 13*b*, and a plurality of fourth electrodes 16*a*, 16*b* which respectively form an output condenser Co for getting a high-frequency signal together with the third electrodes 15*a*, 15*b*. Moreover, on the inner wall of the washing or drying tub 3, a plurality of fifth electrode plates 17*a*, 17*b* are attached at different heights respectively. Incidentally, the fifth electrode plate 17*a* is connected between the second electrode 14*a* and the fourth electrode 16*a*, while the other fifth electrode plate 17*b* is connected between the second electrode 14*b* and the fourth electrode 16*b*. Moreover, the drive system 11 is in conducting relation to water supplied to the washing or drying tub 3 through the shaft 8, and is also connected to the ground. Incidentally, in this embodiment, the plurality of fifth electrodes 17*a*, 17*b* respectively serve as water-level detecting means.

Figure 14:
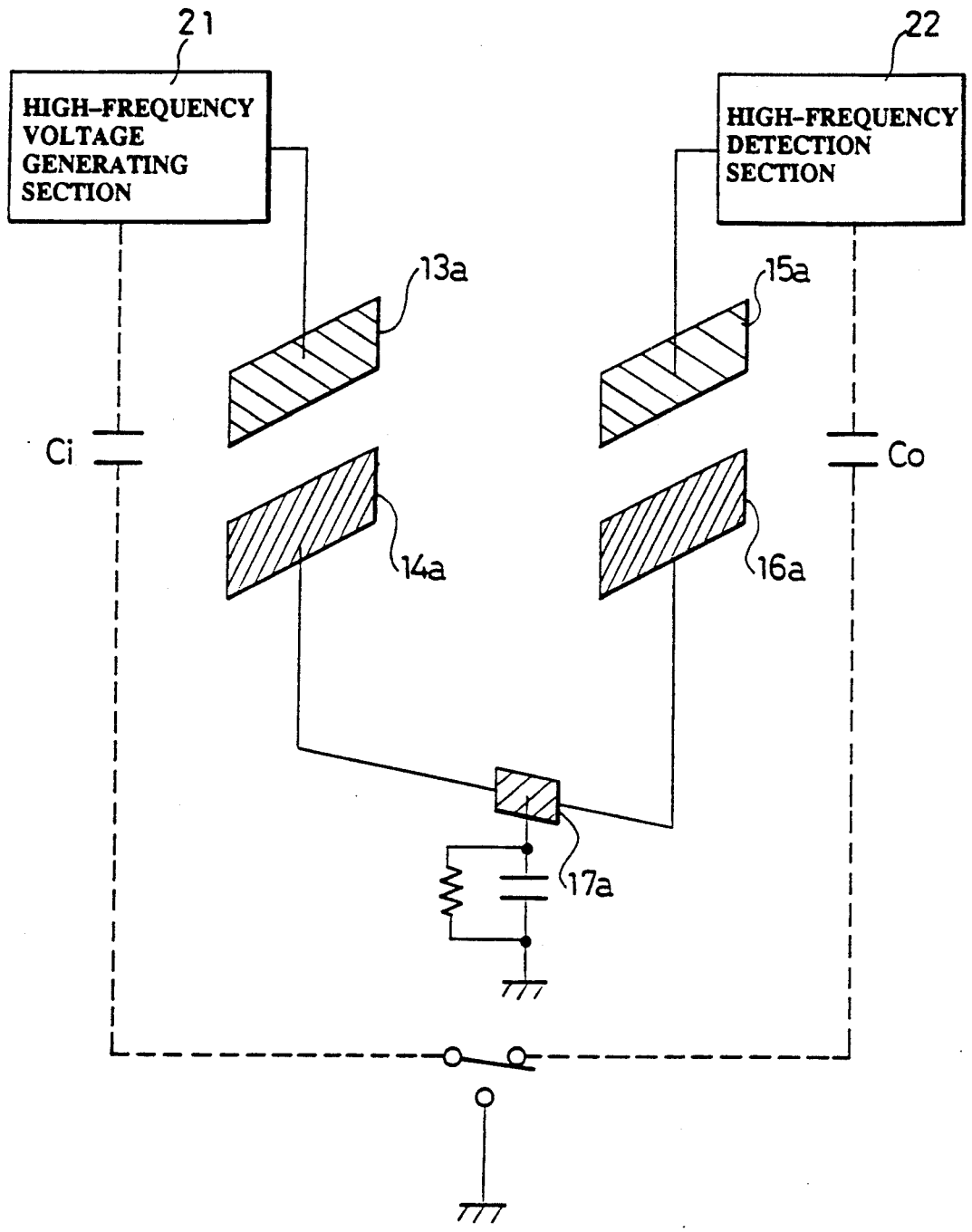
FIG. 14 is a diagram showing a signal route of a high-frequency signal of the second embodiment.

FIG. 14 shows a route of the high-frequency signal. Namely, the high-frequency signal outputted from the high-frequency voltage generating circuit 21 reaches the fifth electrode plate 17*a* on the inner wall of the washing or drying tub 3 through the input condenser Ci composed of the first electrode 13*a* of the outer-tub cover 4 and the second electrode 14*a* of the washing or drying tub 3. Moreover, the signal is transmitted from the fifth electrode plate 17*a* to the fourth electrode 16*a* of the washing or drying tub 3, and is finally inputted to the high-frequency signal detection circuit 22 through the output condenser Co composed of the fourth electrode 16*a* of the washing or drying tub 3 and the third electrode 15*a* of the outer-tub cover 4. In such a state, when water is supplied to the washing or drying tub 3, and the water level reaches between the fifth electrode plate 17*a* of the washing or drying tub 3 and the drive system 11, the high-frequency signal flows away from the fifth electrode plate 17*a* to the ground through water and the drive system 11, so that the high-frequency signal level to be detected by the high-frequency signal detection circuit 22 is attenuated. Accordingly, the comparison result between the water level in the washing or drying tub 3 and the height of electrode plate 17*a* can be obtained by detection of the high-frequency signal level by means of the high-frequency signal detection circuit 22.

Figure 15:
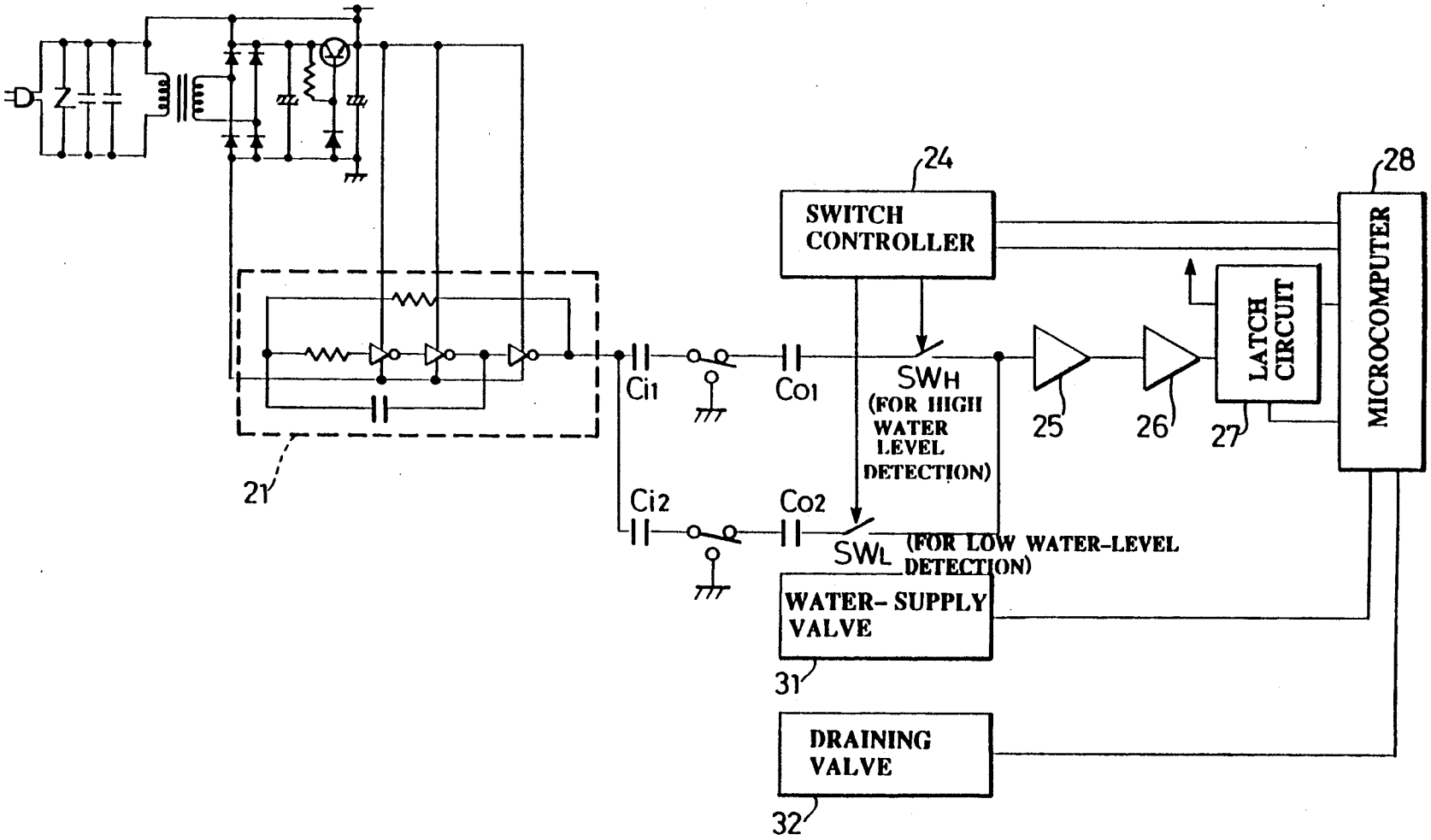
FIG. 15 is a diagram showing a water-level detecting system of the second embodiment.

FIG. 15 shows a system diagram of the water-level detecting means. As mentioned above, if water is supplied in the washing or drying tub 3, the high-frequency signal is propagated through the input condenser Ci, then flows away to the earth through water and drive system 11 from the fifth electrode 17a or 17b to be electrically connected in accordance with the water level. On the contrary, when the water level does not reach the height of the fifth electrode plate 17a or 17b electrically connected to the input condenser Ci, the high-frequency signal is propagated to the output condenser Co. Then, the high-frequency signal passes through the output condenser Co, and is inputted to a filter 25 through a switch SWL for low water level detection or switch SWH for high water level detection, which is selected by a switch controller 24 under control of a microcomputer 28. Then, unnecessary signal frequency components are attenuated by the filter 25. the signal is inputted to a latch circuit 27 through an amplifier 26. Thereafter, based on the output obtained from the latch circuit 27, the microcomputer 28 judges the water level in the washing or drying tub 3 so as to control a water-supply valve 31 or a draining valve 32.

Figure 16:
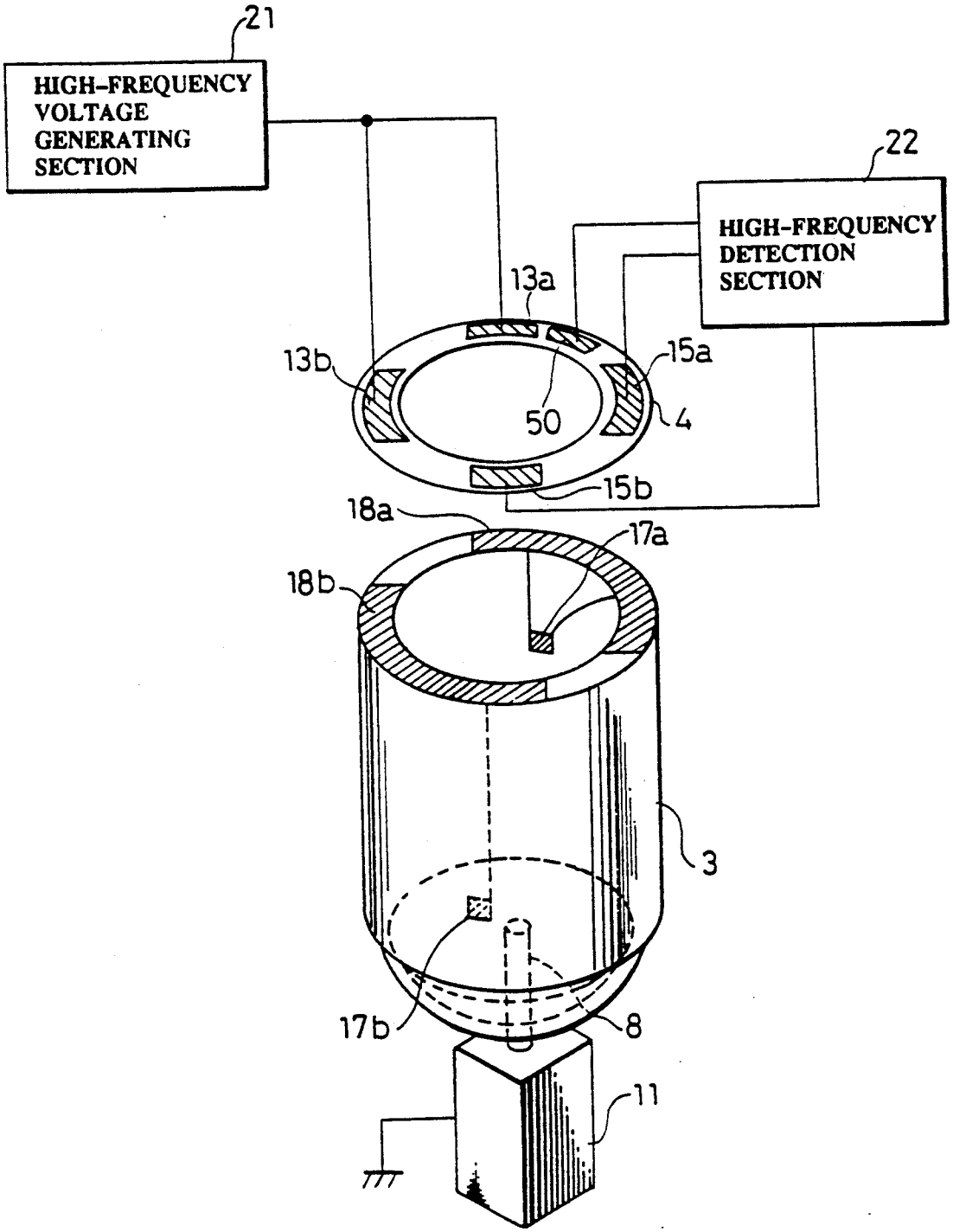
FIG. 16 is a perspective view showing wiring of respective electrodes in a third embodiment according to the present invention.

FIG. 16 shows the wiring system of the respective electrode in the third embodiment of the present invention. This embodiment is so constructed, that in FIG. 13, the second electrode 14a and the fourth electrode 16a are replaced with a seventh electrode 18a, and the second electrode 14b and the fourth electrode 16b are replaced with an eighth electrode 18b. Moreover, among the fifth electrode plates 17a, 17b attached on the inner wall of the washing or drying tub 3 at different heights, the electrode plate 17a is connected to the seventh electrode 18a, while the other electrode plate 17b is connected to the eighth electrode 18b.

An input condenser Ci is defined with the first electrodes 13a, 13b and the seventh and eighth electrodes 18a, 18b. On the other hand, an output condenser Co is defined with the third electrodes 15a, 15b and the seventh and eighth electrodes 18a, 18b.

In this case, the decision of high-frequency signal route, i.e., the water-level detection operation when water is not existent in the washing or drying tub 3 or when the water level reaches the fifth electrodes 17a or 17b is carried out in substantially the same manner as in the second embodiment.

Figure 17:
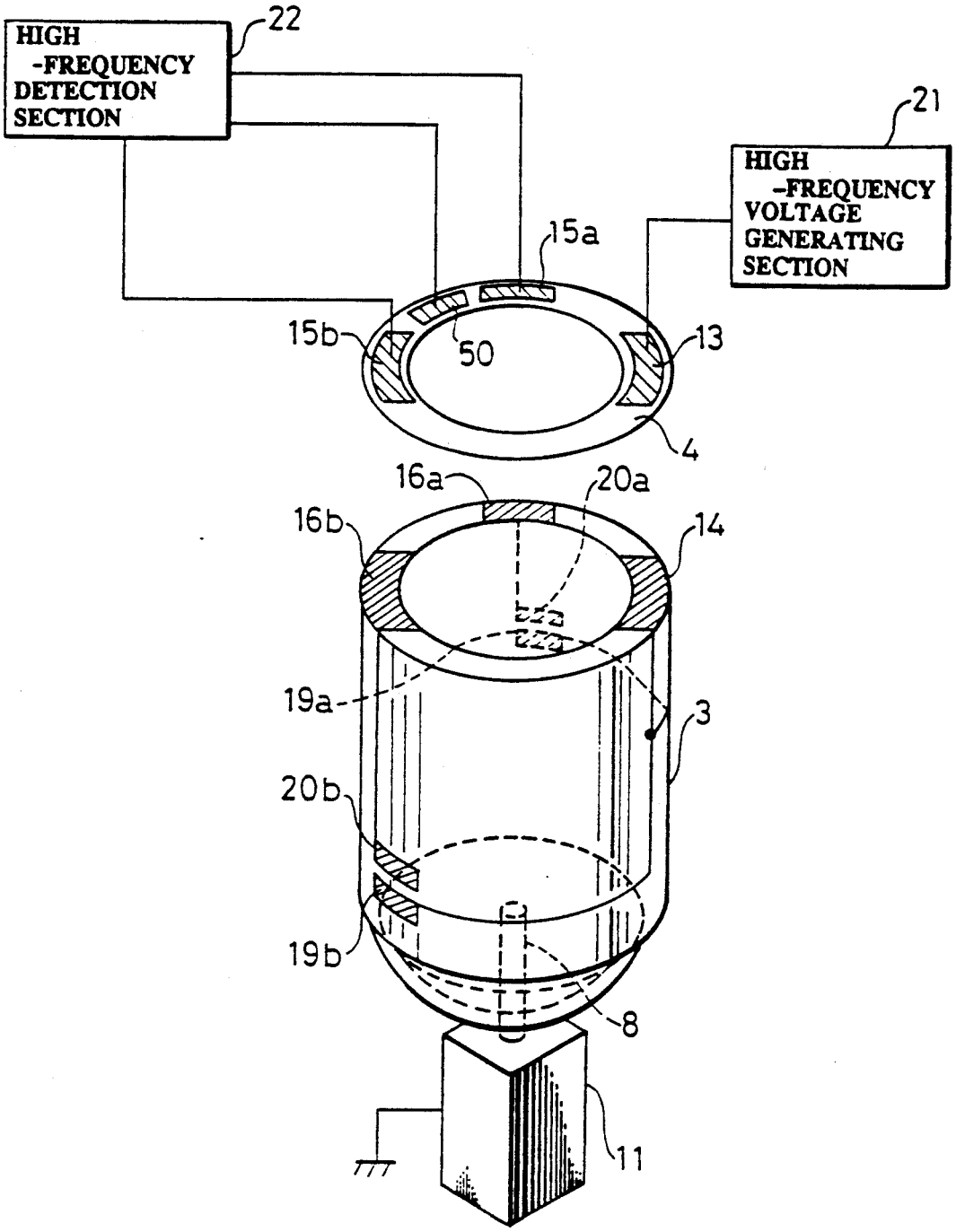
FIG. 17 is a perspective view showing wiring of the respective electrodes in a fourth embodiment of the present invention.
Figure 18:
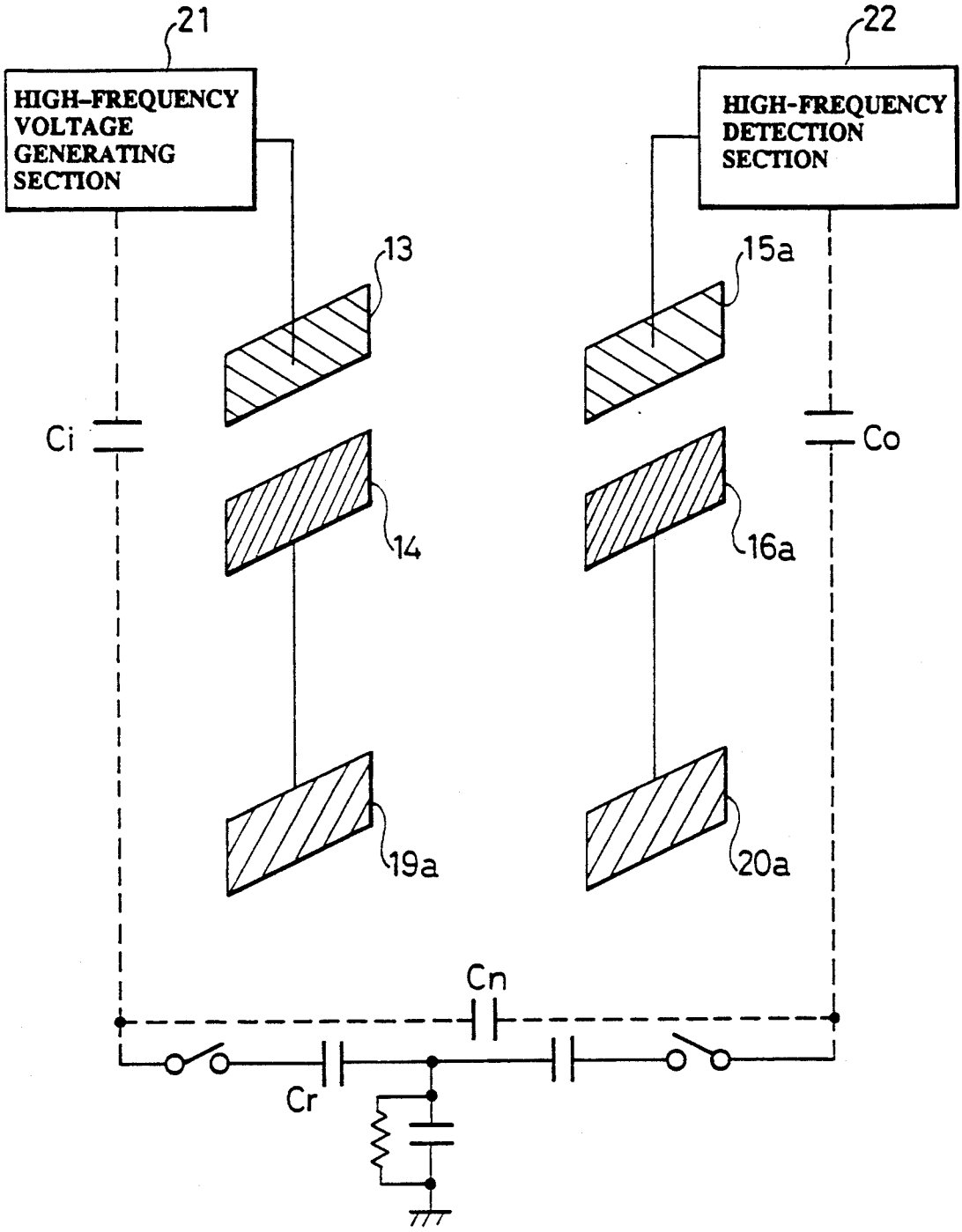
FIG. 18 is a diagram showing a signal route of a high-frequency signal in the fourth embodiment.
Figure 19:
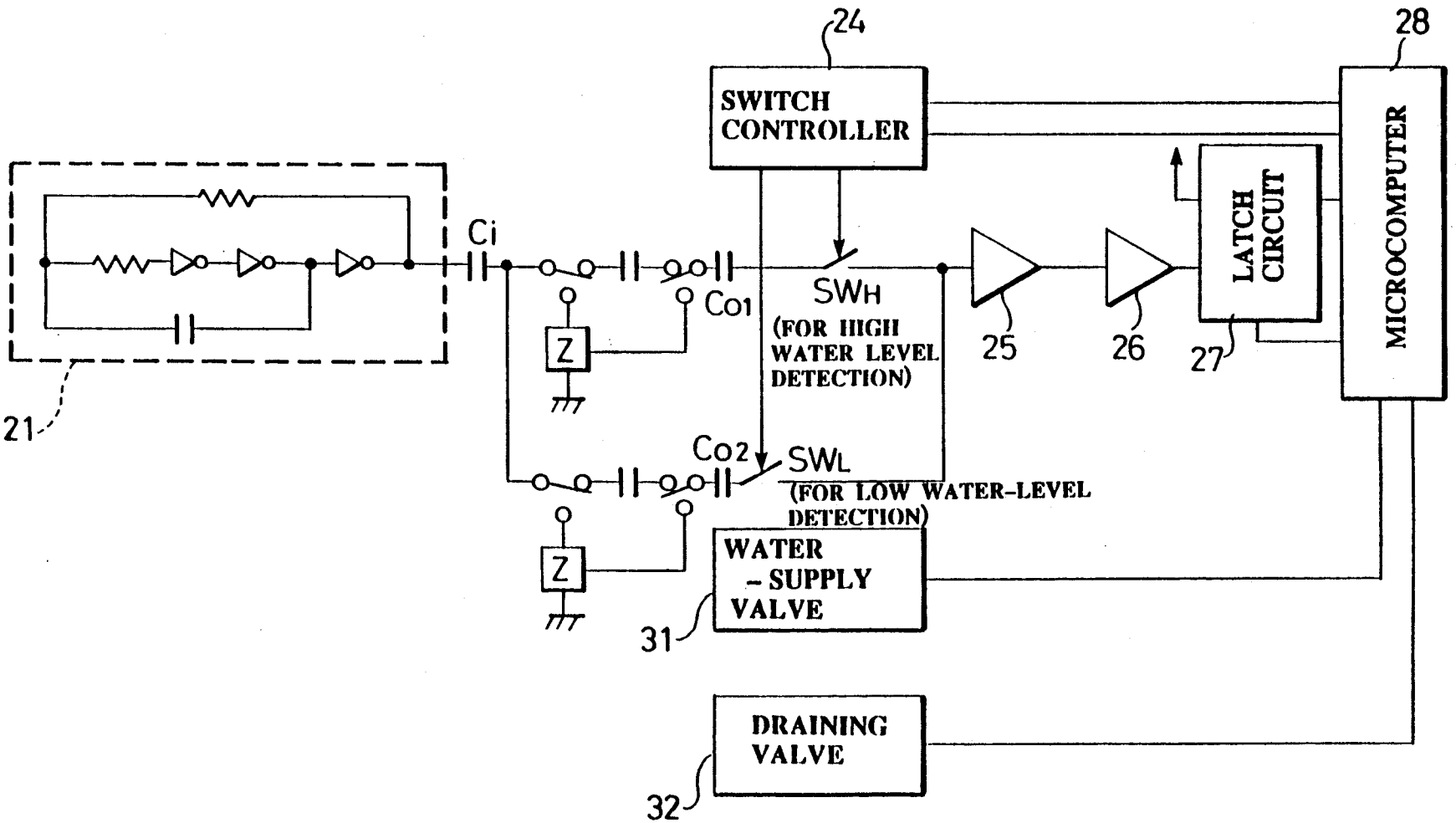
FIG. 19 is a diagram showing a water-level detecting system of the fourth embodiment.

FIGS. 17 to 19 show a fourth embodiment of the present invention.

FIG. 17 shows wiring system of electrodes and the like. In this embodiment, as is similar to the first embodiment, the first electrode 13 connected to the high-frequency voltage generating circuit 21 comprises one piece of electrode, and the second electrode 14 provided at the top portion of the washing or drying tub 3 also comprises one piece of electrode so as to correspond to the first electrode 13. Moreover, on the outer wall of the washing or drying tub 3, a plurality of fifth electrodes 19a, 19b are attached at different heights. In the vicinity of the fifth electrodes 19a, 19b, sixth electrode plates 20a, 20b are respectively provided. In such construction, the fifth electrode plate 19a and the sixth electrode plate 20a define a condenser. Similarly, the other fifth electrode plate 19b and the sixth electrode plate 20b define another condenser. The fifth electrode plates 19a, 19b are connected to the second electrode 14 in common, and the sixth electrode plates 20a, 20b are respectively connected to the fourth electrodes 16a, 16b. In this case, the water-level detecting means comprises the fifth electrode plates 19a, 19b and the sixth electrode plates 20a, 20b.

FIG. 18 shows a route of a high-frequency signal. As show in the same drawing, a high-frequency signal outputted from the high-frequency voltage generating circuit 21 reaches the fifth electrode plate 19a on the outer wall of the washing or drying tub 3 through an input condenser Ci composed of the first electrode 13 of the outer-tub cover 4 and the second electrode 14 of the washing or drying tub 3. Moreover, the high-frequency signal is transmitted to the sixth electrode plate 20a in accordance with a capacity Cn defined between the sixth electrode plate 20a and the fifth electrode plate 19a. Since the sixth electrode plate 20a is electrically connected to the fourth electrode 16a of the washing or drying tub 3, the high-frequency signal finally reaches the high-frequency signal detection circuit 22 through an output condenser Co defined between the fourth electrode 16a of the washing or drying tub 3 and the third electrode 15a of the outer-tub cover 4. When water is supplied to the washing or drying tub 3, and the water level reaches a position corresponding to the fifth electrode plate 19a on the outer wall of the washing or drying tub 3, the high-frequency signal flows away to the ground through the drive system 11 from a condenser Cr comprising the fifth electrode plate 19a and water between which the side wall of the washing or drying tub 3 is inserted as internal dielectric. Therefore, the high-frequency signal level detected at the high-frequency signal detection circuit 22 is markedly attenuated. Accordingly, the compaison between the water level in the washing or drying tub 3 and the height of fifth electrode plate 19a can be carried out by detection of the high-frequency signal level by means of the high-frequency signal detection circuit 22.

FIG. 19 shows a system diagram of the water-level detecting means. As explained above, the high-frequency signal outputted from the high-frequency voltage generating circuit 21 is transmitted through the input condenser Ci, and if water is existent in the washing or drying tub 3, it flows away to the ground through the water and drive system 11 (or through impedance Z) from the fifth electrode plate 19a or 19b which is in the conducting state in accordance with the water level. On the contrary, when the water level does not reach the height of fifth electrode plate 19a or 19b connected to the input condenser Ci, the high-frequency signal is transmitted to output condensers Co1, Co2. Then, the high-frequency signal passes through the condensers Co1, Co2, and is inputted to a filter 25 through a switch SWL or SWH which is selected under control of a microcomputer 28. By filter 25, unnecessary frequency components of the signal are attenuated. Thereafter, the signal is inputted to a latch circuit 27 through an amplifier 26. Then, based on the output from the latch circuit 27, the water level in the washing or drying tub 3 is judged by the microcomputer 28 so as to control a water-supply valve 31 or draining valve 32.

In these embodiments of the present invention, for example in the first embodiment shown in FIG. 3, the fifth electrode plate 19 provided in the washing or drying tub 3 can be regarded as an electronic part such as sensor or the like. Moreover, both of the second electrode 14 connected to the fifth electrode plate 19 and the first electrode 13 provided on the outer-tub cover 4 so as to face the second electrode 14 and connected to the high-frequency voltage circuit 21 can be regarded as power supply means for supplying a power source for the electronic part from the main body of washing machine to the washing or drying tub through space defined between the main body and the washing or drying tub.

As stated above, according to the present invention, the washing machine comprises the washing or drying tub which is rotatably provided in the outer tub, the first electrode which is provided at the upper portion of the outer tub and connected to the high-frequency signal source, the second electrode which is provided at the upper portion of the washing or drying tub and forms an input condenser for high-frequency signal input together with the first electrode, the third electrode which is provided at the upper portion of the outer tub and connected to the high-frequency signal detecting circuit, the fourth electrode which is provided at the upper portion of the washing or drying tub and forms the output condenser, for getting a high-frequency signal, together with the third electrode, and the water-level detecting means which is provided at a predetermined position of the washing or drying tub in electrical communication with the second and fourth electrodes so as to designate change of impedance defined between the second and fourth electrodes in accordance with the water level in the washing or drying tub. Therefore, when water is supplied to the washing or drying tub, and the water level reaches the height of the water-level detecting means, the level of the high-frequency signal transmitted to the high-frequency-signal detecting circuit is changed in accordance with the change of impedance defined between the second and fourth electrodes, so that whether or not the water level reaches predetermined height can be judged from the detection of the signal level change. Accordingly, there can be provided a washing or drying tub for washing machines, which can be produced at low cost and in simple structure and realize highly accurate water-level detection.

Various modifications will become possible for those skilled in the art after receiving the teachings of the present disclosure without departing from the scope thereof.

What is claimed is:

1. A washing machine, comprising:

a fixed outer tub;

a rotatable washing and drying tub disposed within said fixed outer tub;

a first electrode provided at an upper portion of said outer tub and electrically connected to a high-frequency signal source;

a second electrode provided at an upper portion of said rotatable tub and electrically connected to said first electrode, said first and second electrodes forming an input condenser and receiving a high-frequency signal from said high-frequency signal source;

a third electrode provided at said upper portion of said outer tub and electrically connected to a high-frequency signal detecting circuit;

a fourth electrode provided at said upper portion of said rotatable tub and electrically connected to said third electrode, said third and fourth electrodes forming an output condenser and outputting said high-frequency signal to said high-frequency signal detecting circuit; and water-level detecting means for detecting water level, provided at a predetermined position of said rotatable tub and electrically connected to said second and fourth electrodes, such that an impedance between said second and fourth electrodes is changed in accordance with a water level in said washing and drying tub.

2. The washing machine according to claim 1, further comprising:

a dummy electrode provided at said upper portion of said outer tub and electrically connected to said high-frequency signal detecting circuit so as to compensate for noise caused by a floating capacitance between said third electrode and a ground.

3. The washing machine according to claim 1, wherein said water-level detecting means comprises a fifth electrode provided at a first position in said rotatable tub and electrically connected to said second electrode, and a sixth electrode provided at a second position in said rotatable tub and electrically connected to said fourth electrode, said fifth electrode being located on a different level than said sixth electrode.

4. The washing machine according to claim 1, further comprising:

a seventh electrode and an eighth electrode provided on said outer tub and electrically connected to said high-frequency signal detecting circuit; and a ninth electrode and a tenth electrode provided at said upper portion of said rotatable tub, said seventh and ninth electrodes being electrically connected and forming an output condenser, said eighth and tenth electrodes being electrically connected and forming an output condenser.

5. The washing machine according to claim 4, wherein the water-level detecting means comprises:

a fifth electrode provided at a first position in said rotatable tub and electrically connected to said second electrode;

a sixth electrode provided at a second position in said rotatable tub and electrically connected to said fourth electrode, said fifth electrode being located on a different level than said sixth electrode;

an eleventh electrode provided at a third position in said rotatable tub and electrically connected to said ninth electrode, said eleventh electrode being located on a different level than said fifth and sixth electrodes; and a twelfth electrode provided at a fourth position in said rotatable tub and electrically connected to said tenth electrode, said twelfth electrode being located on a different level than said fifth, sixth and eleventh electrodes.

6. The washing machine according to claim 1, further comprising a main body containing said rotatable tub, said main body comprising:

means for electrically operating said washing machine; and power supply means for supplying an electric power to said electrical operating means.

* * * * *